US005359954A

United States Patent [19]

Kordelin

[11] Patent Number: 5,359,954

[45] Date of Patent: Nov. 1, 1994

[54] DECK ELEMENT SYSTEM AND METHOD FOR INSTALLING THE SYSTEM

[75] Inventor: Tapio Kordelin, Turku, Finland

[73] Assignee: Schauman Wood Oy, Finland

[21] Appl. No.: 155,248

[22] Filed: Nov. 22, 1993

Related U.S. Application Data

[63] Continuation of Ser. No. 896,590, Jun. 10, 1992, abandoned.

[30] Foreign Application Priority Data

Jun. 10, 1991 [FI] Finland ..... 912773

[51] Int. Cl.[5] ..... B63B 3/00

[52] U.S. Cl. ..... 114/85; 52/391; 52/588; 52/593; 52/805; 114/84

[58] Field of Search ..... 403/DIG. 10; 428/50; 52/390–392, 594–598, 785, 787, 805; 114/65 R, 72, 73, 76, 82, 84–86, 355, 358; D25/138

[56] References Cited

U.S. PATENT DOCUMENTS

| | | | |
|---|---|---|---|
| 1,842,828 | 1/1932 | Giuliani | 52/574 |
| 1,874,689 | 8/1932 | Alvard | 114/85 |
| 2,594,928 | 4/1952 | Horowitz | 52/574 |
| 3,165,083 | 1/1965 | Romero | 114/65 |
| 3,229,433 | 1/1966 | Miles | 114/85 |
| 3,328,934 | 9/1967 | Hall | 52/391 |
| 3,913,292 | 10/1975 | Braekkan | 52/574 |
| 4,409,269 | 10/1983 | Gardner | 52/391 |
| 4,622,794 | 11/1986 | Geortner | 52/341 |
| 4,700,524 | 10/1987 | Addison | 52/593 |
| 4,727,701 | 3/1988 | Figari | 52/588 |
| 5,016,413 | 5/1991 | Counihan | 52/391 |

FOREIGN PATENT DOCUMENTS

| | | |
|---|---|---|
| 67516 | 12/1984 | Finland . |
| 97868 | 2/1961 | Norway . |

*Primary Examiner*—Robert J. Oberleitner
*Assistant Examiner*—Clifford T. Bartz
*Attorney, Agent, or Firm*—Pollock, Vande Sande & Priddy

[57] ABSTRACT

A layered system for a ship deck including two kinds of elements, namely a deck element and an installation plank. According to the system, at least two opposite edges of the deck element are equipped with a protruding lower part, whereby two of such deck elements can be brought next to each other in a manner that both deck elements have a protruding lower part facing a corresponding part of the other deck element. At least two opposite edges of the installation plank are equipped with a protruding upper part which cover substantially the protruding lower parts of the deck elements when the installation plank is placed between the deck elements which have been placed next to each other in a manner that the protruding lower parts are facing each other. The installation plank is equipped with elements to fasten the deck element system to the deck base.

11 Claims, 5 Drawing Sheets

DECK ELEMENT SYSTEM AND METHOD FOR INSTALLING THE SYSTEM

This application is a continuation of Ser. No. 07/896,590 filed on Jun. 10, 1992, now abandoned.

The invention relates to a deck element system for installing a ship deck.

The planking of a ship deck is conventionally formed of single wooden planks which are fixed to the deck by several fastening bolts. The planks are placed at small intervals from each other so that a joint space is left between each two planks next to each other. After this, all joint spaces are filled with a stuffing mass.

This conventional method for installing planks is very complex and therefore slow to perform. The planks must be fastened at several points, consequently requiring a large number of fastening bolts. In addition, the filling of the joints between the planks is a very difficult operation. Further, the consumption of wood is high, because the planks are of solid wood.

For making the planking work more efficient, plank-imitating elements have been used instead of planks. In this case, most joints can be preformed at the element manufacturing plant, so that the installation onboard can be made more efficiently. However, the installation of elements has not been very successful so far. Problems have occurred with the reliable fastening of single elements both to the deck and to each other. Also, the installed elements tend to warp easily, with the result of a defective deck.

In joining elements, both a tongue-and-groove joint and a so-called joint spring, which is a narrow batten fastened on the side walls of elements next to each other, have been used. In an installation of this kind, the greatest difficulty is how to prevent the movement of the elements sideways. Further, the joints can also easily remain too wide. In the opposite case, on the other hand, too tight joints may easily cause stepping off of the deck elements..

SUMMARY OF THE INVENTION

It is an aim of the present invention to remove the drawbacks presented hereabove and to provide a new, more efficient and secure deck element system for installing a ship deck.

In accordance with the present invention, there is provided a layered deck system which includes a base layer, an upper layer, and means for securing elements of the upper layer together and to the base layer. The upper layer includes deck element planks and have protruding lower ledges on their longitudinal edges and installation planks having protruding upper ledges on their longitudinal edges. The deck elements are spaced apart from each other and the installation planks fit between the deck elements with the protruding upper ledges of the installation planks pressing downwardly on the protruding lower ledges of the deck elements in the nature of a rabbet joint.

The invention is also related to a method for installing the deck element system. Thus it is further the purpose of the invention to provide a new, efficient and secure method to be used in the installing phase of the system.

BRIEF DESCRIPTION OF THE DRAWINGS

In the following, the invention is described as an example with reference to the following drawings, in which.

DETAILED DESCRIPTION OF THE INVENTION

Figure 1:
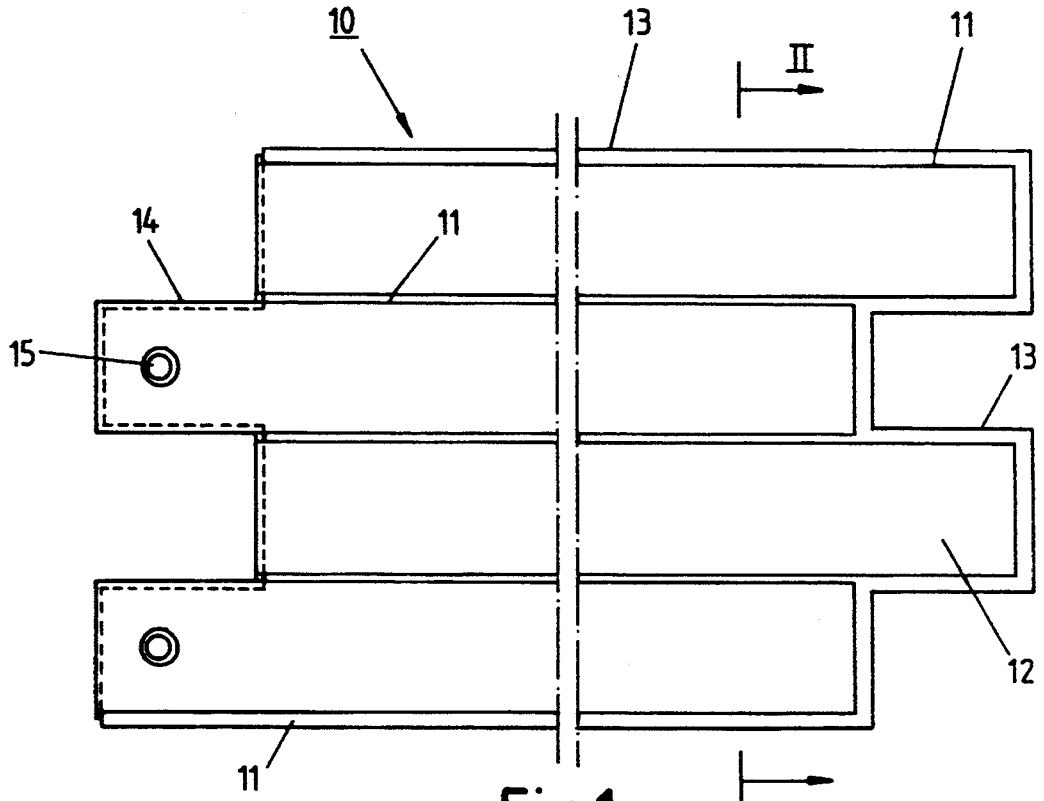
FIG. 1 shows an embodiment of a deck element according to the invention in a plan view seen from above.

FIG. 1 shows an embodiment of a deck element 10 according to the invention as seen from above. The deck element 10 comprises four adjacent planks 12, the joint bands 11 formed of a flexible material therebetween being preformed in the longitudinal direction of the planks 12 and between the same at the factory which manufactures the deck elements 10 to be installed. Also the longitudinal side edges of the deck element 10 readily have the corresponding factory-installed joint bands 11. It should be noted that the number of planks 12 is not restricted to the number of this presented embodiment. Any number of planks 12 in limits of technical possibilities is possible. Reference is made to the embodiment shown in FIG. 9 discussed in detail herebelow.

The planks 12 of the deck element 10, which are preferably of equal size, have been joined together in a manner that the end edges of the element, which are substantially perpendicular to the longitudinal direction of the planks, form a staggered configuration in which the adjacent planks are placed in different positions in the longitudinal direction of the element. The staggered configuration is used to join the elements together by an overlapping connection as shown in detail in FIG. 4. This is a matter affecting primarily the appearance of the ship deck, because the appearance is thus similar to that of a deck formed of separate planks.

Protruding parts 13 and 14 have been formed on all edges of the deck element 10 in a way that three edges (both of the longitudinal edges and one of the two substantially perpendicular ones) comprise the lower protruding part 13, and only one of the two perpendicular edges, namely at the left edge of the deck element 10 of FIG. 1, comprises the protruding part 14. Also the holes 15 for the fastening bolts of elements 10 are placed near the upper protruding parts 14 only, i.e. at the left end of the element 10 in FIG. 1. The protruding parts 13 and 14 have been formed in order to accomplish halved joints between the adjacent deck elements 10 and planks 20 as well. The protruding part has the overall construction as a continuous flange or lip extending outwards and substantially having the thickness or the height corresponding to half of the total thickness or height of the deck element 10 or of the installation plank 20.

Figure 2:
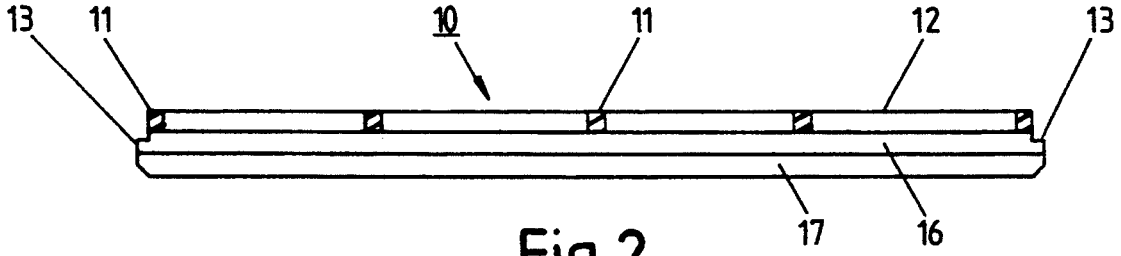
FIG. 2 shows a view of the cross-section along the line II—II in FIG. 1.

FIG. 2 shows the cross-section of one advantageous embodiment of the deck element 10 of FIG. 1. As seen in the figure, the deck element 10 is a layered construction comprising three layers. Only the upper-most visible surface layer, namely the one that makes the impression that the deck is of conventional structure comprising deck planks 12, is of teak or a corresponding wood-based material that is commonly used as the surface material of a ship deck. The deck element base comprises two unitary layers 16 and 17 of plywood therebelow, with the main purpose of providing subsequently a good support for the surface layer imitating deck planks 12 and improving the strength properties of the deck element 10. FIG. 2 shows also the joint bands 11 at the spaces between the surface layers imitating the deck planks 12. Joint bands 11 are also placed above the lower protruding parts 13 against the edge surfaces at the surface layer imitating the deck planks 12 facing outwards along the longitudinal edges of the element 10. The lower protruding parts 13 formed to the edges of the deck element 10 substantially comprise the layers 16 and 17 of plywood. Thus at the longitudinal edges of the deck element 10, the lower protruding parts 13 project substantially outwards from the edges of the joint bands 11.

Figure 3:
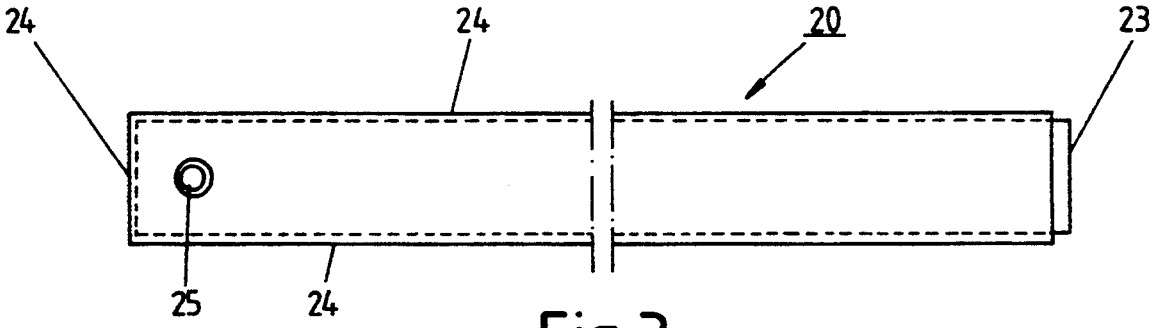
FIG. 3 shows an installation plank for the installation of deck elements according to the invention in a plan view seen from above.

FIG. 3 shows the installation plank 20 for the installation of deck elements 10 according to the invention. It is installed last between the elements 10, as is shown in the following figures, and the purpose of the installation plank 20 is to interlock the elements 10, whose longitudinal edges are parallel with the longitudinal edges of the installation plank 20. Consequently, the protruding parts 23 and 24 surrounding the edges of the installation plank 20 are to be used in the interlocking phase as locking elements. The protruding parts on three edges (i.e. the longitudinal edges and one of the perpendicular edges) are provided with upper protruding parts 24 substantially comprising the uppermost layer of teak or the like, and only one edge, i.e. at the right end of FIG. 3, is provided with a lower protruding part 23 comprising substantially two layers of plywood. Thus the installation plank 20 can be made of similar layered construction as the deck element 10 described hereabove. Respectively, the installation plank 20 has a hole 25 for the fastening bolt at the end with an upper protruding part 24.

Figure 4:
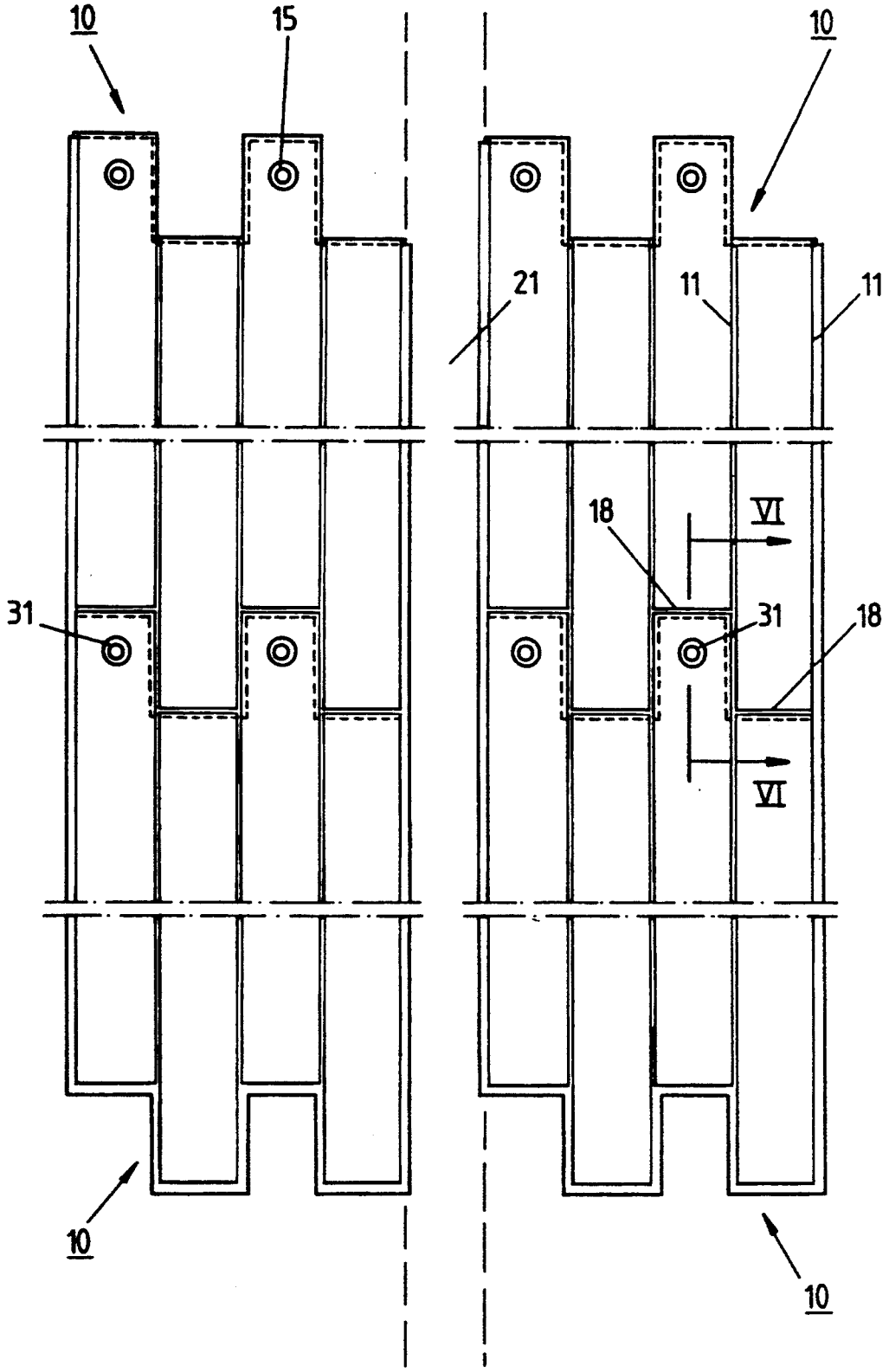
FIG. 4 shows the stage of installation of the deck elements according to FIG. 1 in a plan view seen from above, FIG. 5 corresponds to FIG. 4 and shows the deck elements as installed and fixed by means of an installation plank.

FIG. 4 shows the stage of installation of the deck elements 10 according to FIG. 1 as seen from above. The elements 10 are installed as extensions of each other in a way that the forked edges are connected to each other by means of a lap joint whereby the protruding end parts of the connected elements 10 form a halved joint as well. At the installation stage, a feeler gauge of the width of the installation plank 20 is placed between the adjacent elements parallel with the longitudinal edges of the same. After this stage, the deck elements 10 are locked by nuts 31 in cooperation with the fastening bolts 30 fixed to the deck base 32. As seen from FIG. 4, an elongated space 21 is left between adjacent deck elements 10 having longitudinal edges of the same facing each other to restrict the said elongated space after the feeler gauge is removed, said space having exactly the width of the installation plank 20.

Figure 5:
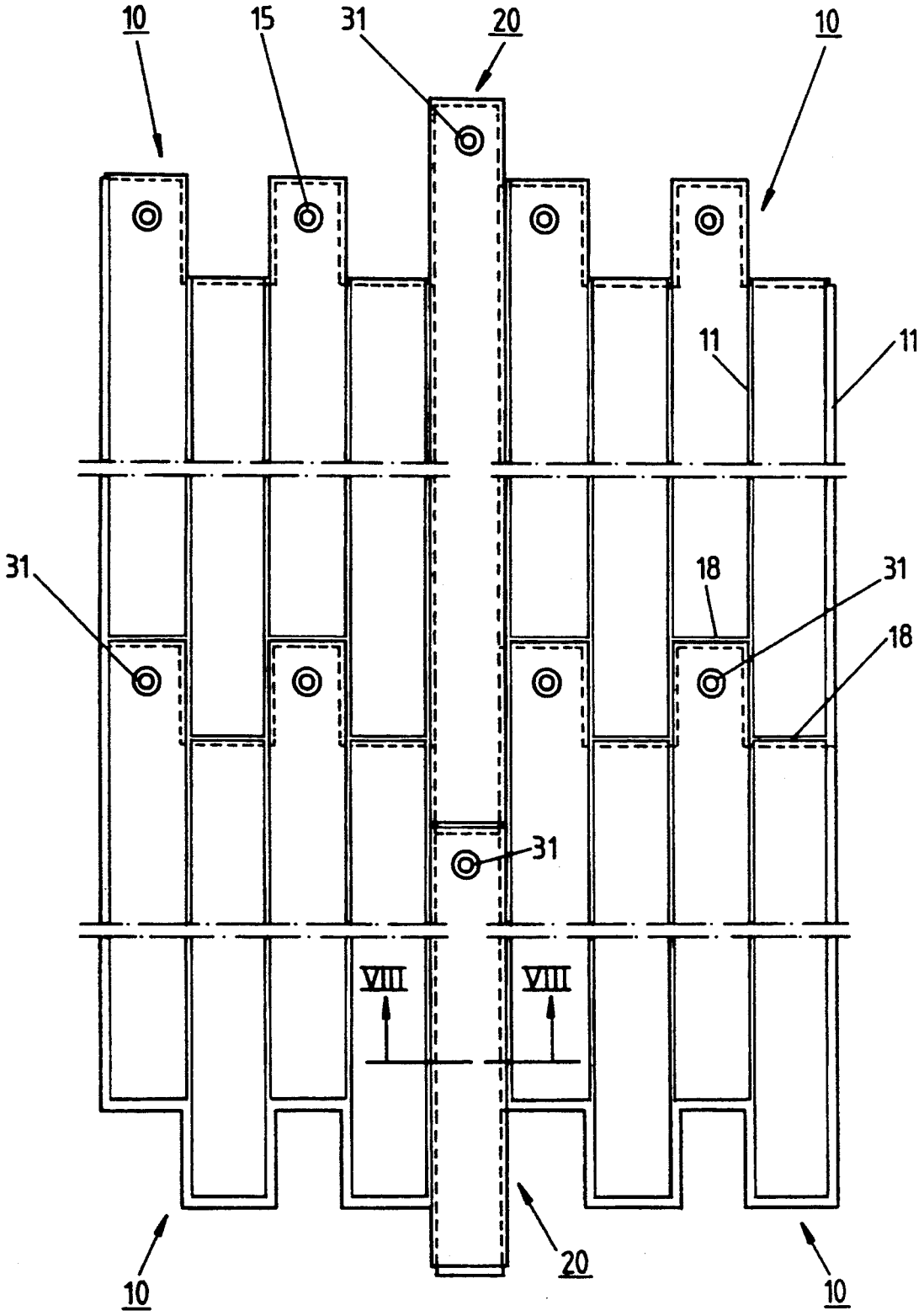
Figure 6:
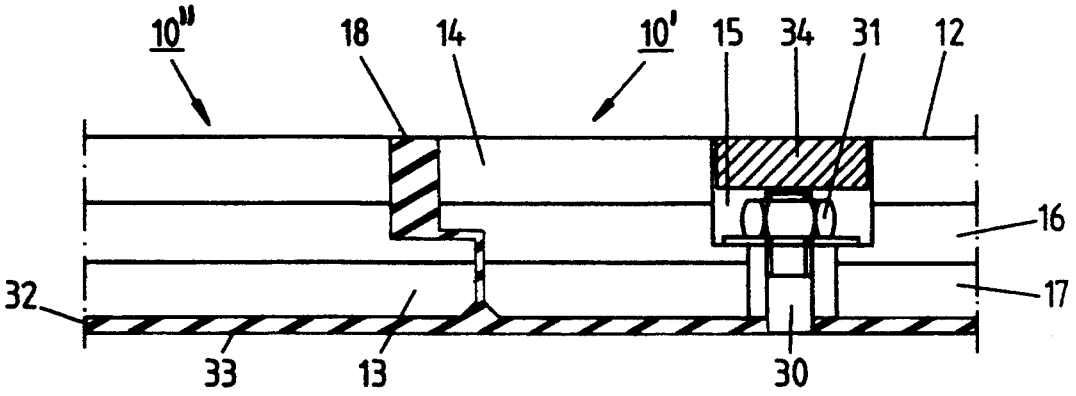
FIG. 6 shows a cross-section along the line VI—VI of FIG. 4.

FIG. 5 shows the next stage of the installation of deck elements 10. The installation planks 20 are already pressed in position in the elongated space 21 left between the deck elements 10 and connected by the nut 31 to the fastening bolt fixed to the deck base 32. Because there are upper protruding parts 24 on both longitudinal edges of the installation plank 20, they lock the deck elements 10 on both sides tightly in position. In this respect, the deck has the appearance of a finished boarding. After this, only wooden plugs 34 or the like (FIG. 6) are inserted in the fastening holes above the nuts 31, and the deck is smoothed. FIG. 6 shows a detail of the deck element structure as a cross-section along the line VI—VI of FIG. 4. FIG. 6 shows the substantially halved joint between two deck elements 10, in which the upper protruding part 14 of the first element 10' is placed above the lower protruding part 13 of the second element 10''. A flexible joint band 18 or a corresponding filling mass is inserted between the spaced frontal surfaces of the part of the halved joint which substantially corresponds to the height of the upper protruding part 14.

A base mass 33 is spread between the deck base 32 and the elements 10 as a filler. The deck elements 10 are fixed to the deck base 32 by means of fastening bolts 30 welded to the deck base 32 and nuts 31. Finally, a wooden plug 34 or the like is inserted above the nuts 31 in the hole and the deck is smoothed.

Figure 7:
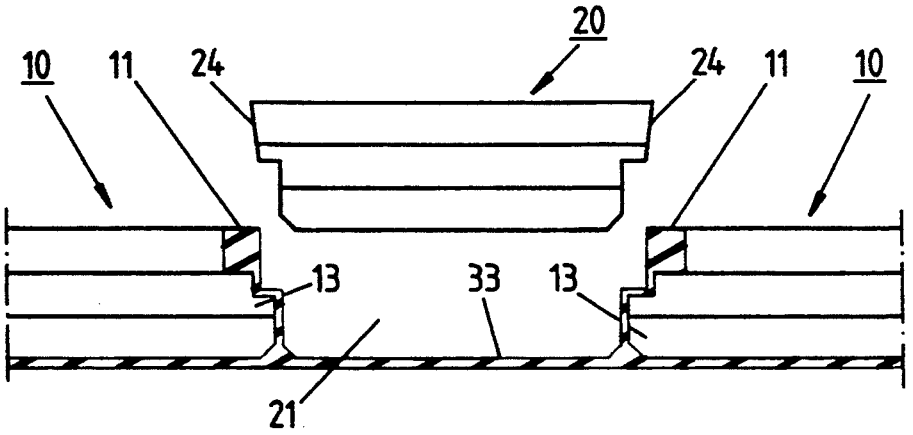
FIG. 7 shows the installation of the installation plank of FIG. 3 between the deck elements of FIG. 4.

FIG. 7 shows the stage of installing the installation plank 20 in cross-section. The installation plank 20 shown in FIG. 3 is pressed in the elongated space 21 between the adjacent deck elements 10 shown in FIG. 4. The edges of the deck elements 10 at the region of the joint are equipped with joint bands 11 as described above so that a similar appearance will be achieved also between the longitudinal edges of the planks 20 and the adjacent elements 10 as compared with the adjacent planks 12 or the surface layer imitating the planks 12 in an individual deck element 10. The stuffing of the joint is further secured by the stuffing mass 33 spread on the deck base 32 which during installation also fills any slits between installation planks 20 and deck elements 10 as well as between the adjacent deck elements 10.

Figure 8:
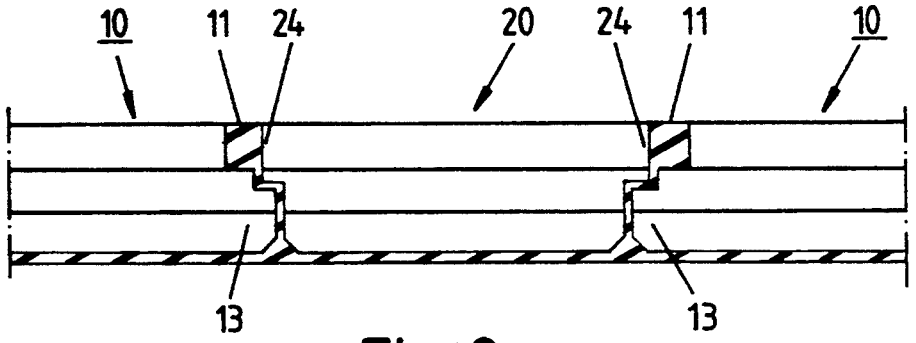
FIG. 8 shows a cross-section along the line VIII—VIII of FIG. 5.

As described hereinabove, the installation plank 20 is also locked by a locking nut to the deck base 32. FIG. 8 shows how the upper protruding parts 24 of the installation plank 20 press the lower protruding parts 13 of the adjacent deck elements 10 and lock the deck elements 10 according to the invention efficiently in position against the deck base 32.

Figure 9:
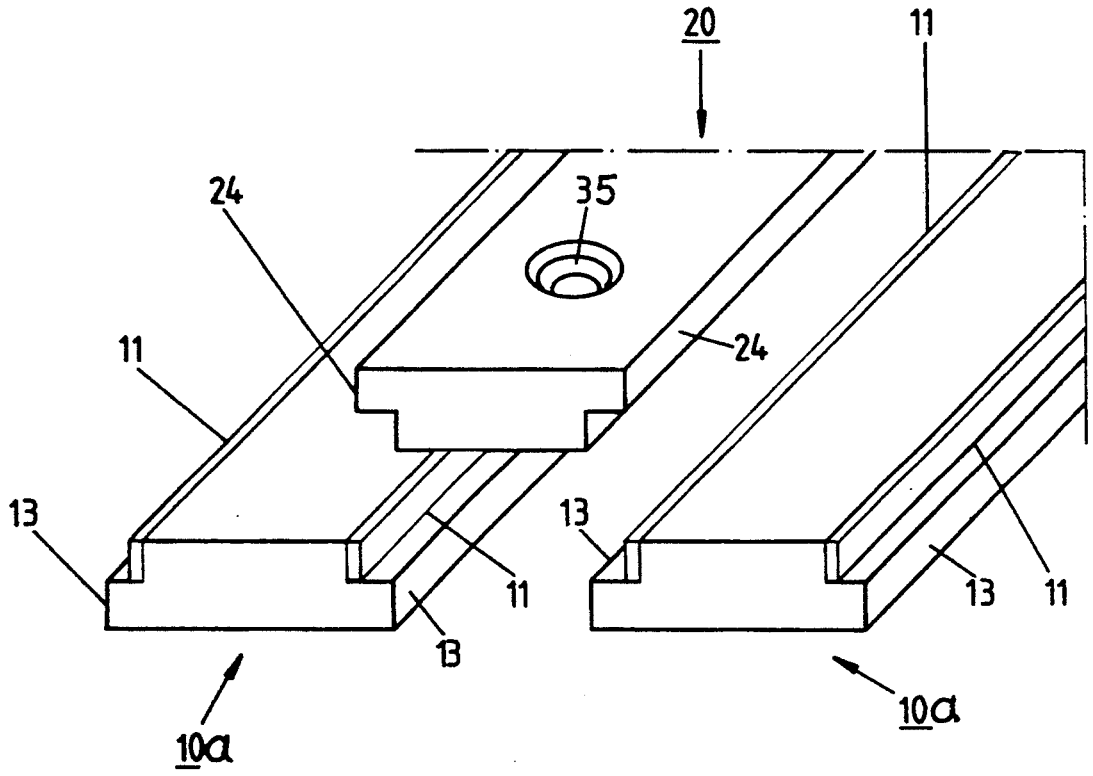
FIG. 9 shows the installation of deck elements by the method according to the invention in a perspective view.

FIG. 9 shows a method for installation of deck plank elements **10*a* instead of elements. Planks of solid teak can be used to form deck plank elements 10*a* similar to those presented in FIGS. 1–8. The deck plank elements 10*a* facing the deck base have lower protruding parts 13 and joint bands 11 readily in position. Correspondingly, an installation plank 20 with upper protruding parts 24** is inserted in every other elongated space in a manner described hereabove.

The planking is locked in position by fastening bolts to be installed through holes 35 in the installation plank 20. In comparison with conventional planking, the method according to the invention provides the advantage that only every other installation plank needs to be fastened. Thus, only half of the number of valuable stainless bolts are needed. Consequently, the weight of the ship deck is reduced, which is advantageous also for the stability of the ship.

It is obvious to a man skilled in the art that different embodiments of the invention may vary within the limits of the claims as presented below.

I claim:

1. A layered deck system comprising in combination, a plurality of deck elements and a plurality of installation planks for installation on a deck base, each of said deck elements comprising a base layer and an upper layer, said base layer comprising a base plate defining substantially the planar dimensions of a deck element and said upper layer comprising at least two deck element planks, each of said planks being fastened on the base layer, each of said deck elements further comprising a pair of longitudinal edges, and a pair of end edges substantially perpendicular to said longitudinal edges, said pair of longitudinal edges adapted for receiving an installation plank, and said pair of end edges provided with means for receiving an adjacent deck element to accomplish direct joint connection between the two deck elements, said pair of longitudinal edges having protruding lower ledge portions configured to face in a spaced-apart position a protruding lower ledge portion of another deck element, said installation planks having longitudinal edges with protruding upper ledge portions resting on and substantially covering the protruding lower ledge portions at the longitudinal edges of said spaced-apart deck elements, each of said installation planks having substantially the same visible surface dimensions and appearances as each of the deck element planks, at least said installation planks being provided with means for securing said installation planks against the deck base and thus securing said deck system on the deck base, the deck element planks and the installation planks having upper deck surfaces which form the visible surface of the deck system.

2. A deck system according to claim 1, wherein said at least two planks of said deck elements are horizontally spaced apart and the resulting space is filled with a resilient material.

3. A deck system according to claim 1, wherein said base layer is plywood and said upper layer planks of said deck elements are teak.

4. A deck system according to claim 1, wherein said protruding lower ledge portions of the deck element is formed of the same material as said base layer.

5. A deck system according to claim 1, wherein said protruding upper ledge portions of the installation planks are formed of the same material as the remainder of the installation planks.

6. A deck system according to claim 1, wherein the edges of said deck elements are provided with a band of resilient material.

7. A deck system according to claim 1, wherein said means for securing said deck system to said deck base comprises at least one bolt member passing through a through-hole penetrating an installation plank.

8. A deck system according to claim 1, wherein said means for securing said deck system to said deck base comprises a bolt member projecting upwards from said deck base through said installation plank for receiving a nut member which locks at least one of the deck element planks and an installation plank against the deck base.

9. A deck system according to claim 8, wherein a plug covers said nut member.

10. A deck system according to claim 1, wherein said deck element planks are substantially equally sized, and adjacent planks are displaced from each other in the longitudinal direction to provide a staggered end profile.

11. A deck system according to claim 1, wherein the deck element planks and the installation planks are substantially equal sized and adjacent planks are longitudinally displaced from each other to form staggered end portions with an inverse order of configuration at first and second opposite ends for providing lapped joints when placed end to end, said first end having a protruding lower edge and said second end having a protruding upper ledge, whereby deck elements placed end to end are joined together at their ends, forming a rabbet joint.

* * * * *